United States Patent [19]

Wohlfart

[11] Patent Number: 4,534,611

[45] Date of Patent: Aug. 13, 1985

[54] CONTACT SPRINGS

[75] Inventor: Artur Wohlfart, Munich, Fed. Rep. of Germany

[73] Assignee: Siemens Aktiengesellschaft, Berlin & Munich

[21] Appl. No.: 645,514

[22] Filed: Aug. 27, 1984

Related U.S. Application Data

[63] Continuation of Ser. No. 388,181, Jun. 14, 1982, abandoned.

[30] Foreign Application Priority Data

Jun. 23, 1981 [DE] Fed. Rep. of Germany ... 8118274[U]

[51] Int. Cl.[3] ..... H01R 13/428

[52] U.S. Cl. ..... 339/217 S; 339/258 R

[58] Field of Search ..... 339/217 S, 258 R, 252 P, 339/217 R, 258 P, 258 RR

[56] References Cited

U.S. PATENT DOCUMENTS

| | | | |
|---|---|---|---|
| 3,412,369 | 11/1968 | Fox | 339/217 S |
| 3,614,706 | 10/1971 | Kulka | 339/217 S |
| 3,634,819 | 1/1972 | Evans | 339/252 P |
| 3,865,462 | 2/1975 | Cobaugh | 339/217 S |
| 3,990,768 | 11/1976 | Faber | 339/217 R X |
| 4,007,977 | 2/1977 | Bauerle | 339/217 S |
| 4,274,701 | 6/1981 | Bannert et al. | 339/217 S |

FOREIGN PATENT DOCUMENTS

| | | | |
|---|---|---|---|
| 851213 | 7/1949 | Fed. Rep. of Germany | 339/217 S |

*Primary Examiner*—William R. Briggs

*Attorney, Agent, or Firm*—Hill, Van Santen, Steadman & Simpson

[57] ABSTRACT

A contact spring assembly is constructed of a planar base plate integrally formed with a pair of opposed spring legs upstanding therefrom and a separate pin-like connection part attached to the undersurface of the base plate and extending downwardly therefrom in a direction opposite from the upstanding course of the spring legs. Opposed axial ends of the base plate are formed with planar flange surfaces which extend outwardly from the adjacent ends of the spring legs. A two piece strip housing is formed with upper and lower parts which assemble together to receive the contact spring assembly suitably therein with the flange surfaces of the base plate locked against upward or downward longitudinal movement by virtue of sidewall recesses. When the connection part is pressed into the grid bore of a printed circuit board, the impression force is transferred from the upper part of the strip housing over the flange surfaces to the base plate and from the base plate to the connection part, without stressing the contact spring legs.

4 Claims, 3 Drawing Figures

CONTACT SPRINGS

This is a continuation of application Ser. No. 388,181, filed June 14, 1982, now abandoned.

BACKGROUND OF THE INVENTION

The invention relates to electrical contact strips for use with plug-in components and solderless connectors and, more particularly, to a contact spring construction intended for mounting in a strip housing having a contact spring part and a connection part.

Spring strip housings are known to be made of insulated material and equipped with contact springs. The housings are fixed to the transverse component of a plug-in rack, so that when a plug-in unit is connected, contact blades or pins secured to the end of the plug-in unit penetrate between the contact springs and thus establish an electrical connection between the rack wiring and the electrical devices arranged in the plug-in unit. Solderless connections are increasingly being used for connections with such contact springs and strip housings.

One known contact spring construction is disclosed in U.S. Pat. No. 3,990,768. There, a base end of the contact spring is spot welded to a connection pin part adjacent a right-angle bent portion thereof. This bent portion of the connection pin is pinched in a recess between upper and lower housing parts of the contact spring strip or strip housing. By this structure, the connection pin parts of the contact springs are safely fixed in the strip housing not by means of the contact springs but substantially independently of the latter. Mechanical forces on the connection pins, such as torsion stresses which particularly occur when the connection part is employed as a wrap stem, are transmitted directly to the housing and absorbed thereby rather than by the contact springs.

However, when the sections of the connection pin parts projecting from the strip housing are employed as contact blades which are intended to be pressed into the grid bores of a printed circuit board, then the right-angle bent portion of the connection pin fixed in the housing is less suited for intercepting or transmitting the forces occurring during impression. An object of the present invention is to provide a contact spring formed with a contact spring part and a connection pin part in such a manner that the mechanical forces occurring during impression of the connection parts projecting from the strip housing into grid bores on a printed circuit board are consistently transferred to the strip housing without the contact spring part of the contact spring being negatively affected.

SUMMARY OF THE INVENTION

A contact spring is constructed with opposed contact spring legs attached at the lower ends thereof to transverse opposed edges of a planar base plate disposed in a plane perpendicular to the upright course of the contact spring legs. The base plate is provided with enlargement flange surfaces at opposed axial ends facing exterior of the contact spring legs. A pin-like connection part is supported beneath the base plate facing away from the contact spring legs.

The flange surfaces on the base plate serve as mounting projections received in suitable recesses formed in the strip housing for support of the contact springs therein. The free end of the connection part may be pressed into the grid bore of a printed circuit board and, as a result of the fitting of the base plate flange surfaces within the strip housing, the forces occurring during such impression are transmitted to the base plate and then to the housing. In this manner, the impression forces are prevented from being transmitted along the contact spring legs which could cause them to be damaged or broken. The adjacent surfaces of the contact spring legs are cut free of or disconnected from the adjacent facing surfaces of the base plate end flanges. In this manner, the enlargement flange surfaces on the base plate may be made completely flat without the cross-section of the contact spring leg being enlarged as the result of the curvature of the contact spring leg which begins at the attachment point to the base plate.

The connection pin part of the contact spring is preferably provided with a relatively enlarged intermediate portion defining a hollow center. The opposed branches of the intermediate enlarged connection part may be pressed against one another when the connection part is pressed into the grid bore, such that a tight fit contact may be made with the metal wall of the grid bore.

DESCRIPTION OF THE PREFERRED EMBODIMENT

Figure 1:
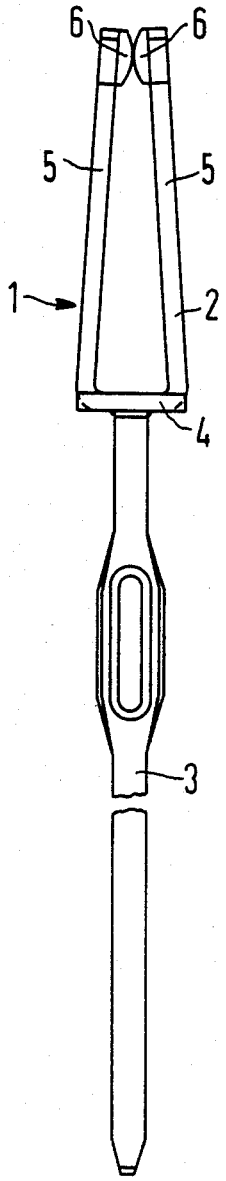
FIG. 1 is an end elevational view of a contact spring assembly constructed in accordance with the present invention.
Figure 2:
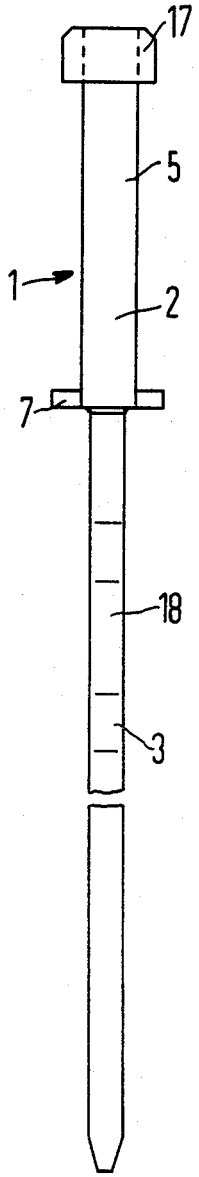
FIG. 2 is a side elevational view of the contact spring of FIG. 1.

As shown in FIGS. 1–2, a contact spring assembly 1 constructed in accordance with the present invention comprises a contact spring part 2 and an attached connection pin part 3. The contact spring part 2 includes a planar base plate 4 which is disposed in a plane perpendicular to the upstanding course of the contact spring part 2 and a pair of contact spring legs 5 integrally formed with the base plate 4 and upstanding from opposed transverse edges of the base plate. The spring legs 5 are formed with contact portions 6 at their free ends for receiving therebetween a suitable contact pin or blade (not illustrated).

The base plate 4 is provided with planar extension enlargements or flange surfaces 7 at opposed axial ends of the plate and disposed exteriorly the opposed axial ends of the spring legs 5.

Figure 3:
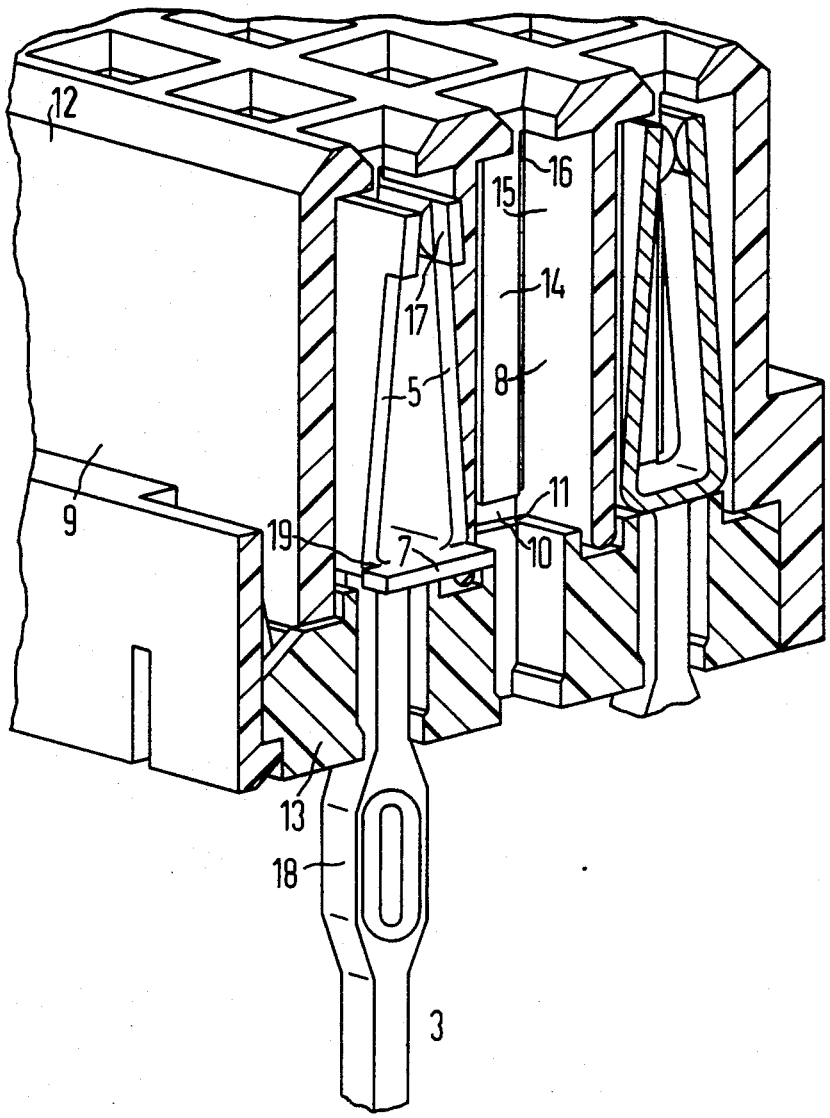
FIG. 3 is a broken-away, cross-sectional perspective view of contact spring assemblies inserted within a strip housing constructed in accordance with the present invention.

With reference to FIG. 3, there is shown a strip housing 9 made of synthetic, insulative material formed with a plurality of individual upstanding hollow chambers 8 for receiving the contact spring parts 2 of corresponding contact spring assemblies. The strip housing 9 comprises separate, detachable upper 12 and lower 13 housing parts. Formed along the sidewalls defining the insertion chambers 8 are axially opposed rib edges 14 which project into the interior of each corresponding chamber. The lower end of each rib 14 terminates short of the bottom surface of the upper housing part 12 to define therebeneath a recess 10. When the lower housing part 13 is fitted against the bottom wall of the upper housing part 12, upstanding support walls or ledges 11 formed along the top surface of the lower housing part 13 project into the chambers 8 spaced beneath the lower ends of the ribs 14 by the recess areas 10. By virtue of this construction, the contact spring parts 2 of the contact spring assemblies 1 are supported within the insertion chambers 8 by virtue of the flange surfaces 7 being held against upward or downward longitudinal movement between the lower ends of the ribs 14 and the ledge support walls 11.

The other transverse opposed sidewalls 15 of each insertion chamber 8 are relatively planar for facing toward the planar back surfaces of the contact spring legs 5. Upstanding grooves 16 are formed on opposed transverse sides of each rib 14 between adjacent rib edge walls and planar sidewalls 15 within each insertion chamber 8 for receiving therealong axially outward extending guide projections 17 formed on opposed axial ends of the free ends of the spring legs 5. The guide projections 17 ride within the grooves 16 during insertion of the spring part into the housing chamber 8 such that, upon completion of insertion, the opposed contacts 6 of the spring part are suitably gapped across from one another to receive therebetween a contact pin or blade.

The opposed axial ends of each contact spring leg 5 are cut free or gapped at an area 19 where the spring leg connects with the base plate 4 so as to be disconnected from the adjacent facing surface of the corresponding flange portion 7. In this manner, the flange surfaces 7 may be made completely flat without being enlarged as a result of the curvature of the contact spring legs which arises at their attachment point to the base plate 4.

The pin-like connection part 3 is welded at its upper end flush to the bottom surface of the base plate 4 facing away from the contact spring part 2. The longitudinal length of the connection part 3 proceeds oppositely away from the upstanding course of the contact spring part 2. The connection part 3 is formed with a relatively enlarged cross-section 18 intermediately therealong as the result of the formation of separate or split-apart branches or legs defining therebetween a hollow center. The lower free end of the connection part 3 is adapted to be situated inside the grid bore of a printed circuit board during an impression step to establish electrical contact. The two branches or legs in the enlarged section 18 of the connection part 3 are adapted to be elastically pressed against one another when the connection part is pressed into the grid bore of the printed circuit board. This produces a tight fit contact within the grid bore between the connection part 3 and the metal wall of the bore.

During the impression step connection of the contact spring assembly part 3 into the grid bore of the printed circuit board, the contact spring portion 2 of the assembly is disposed within the strip housing 9. By virtue of the support of the base plate flange surfaces 7 within the housing recesses 10, the impression force may be transferred from the upper housing part 12 onto the base plate 4 and along the connection part 3 without stressing the contact spring legs 5. Thus, mechanical forces on the contact spring legs 5 are avoided and deformation or breakage of the contact spring legs is prevented.

Although various minor modifications may be suggested by those versed in the art, it should be understood that I wish to embody within the scope of the patent warranted hereon all such modifications as reasonably and properly come within the scope of my contribution to the art.

I claim as my invention:

1. A contact spring assembly for mounting in an insertion chamber of a housing having detachable upper and lower parts containing respective upper and lower portions of said insertion chamber, said contact spring assembly comprising a symmetrical contact spring part, having a planar base plate and a pair of like spring legs upstanding from opposed sides of said base plate, and a connection pin welded at its upper end flush to the undersurface of said base plate and extending longitudinally with the upstanding course of said spring legs, said base plate having symmetrical, opposed end flanged surfaces projecting laterally outward from corresponding adjacent edges of said spring legs for being supported in corresponding recesses defined between corresponding surfaces on said upper and lower parts in said housing against longitudinal movement in said chamber such that said contact spring part is contained in said chamber and said connection pin free end projects out of said housing, wherein said upper portion of said insertion chamber has opposed, laterally inward projecting ribs, each rib defining at its lower end an upper edge to the corresponding recess and along its opposed sides guide edges for travel projections formed on the free ends of said spring legs, said flanged surfaces being held against upward longitudinal movement by said lower ends of said ribs.

2. The contact spring assembly of claim 1, wherein said spring legs are gapped from adjacent facing edges of said flanged surfaces on said base plate, whereby said flange surfaces are each of constant cross-section therealong.

3. The contact spring assembly of claim 1, wherein said connection pin is formed with an intermediate relatively enlarged section having opposed branch portions defining a hollow center and enabling an elastically deformable contact connection for an associated grid hole of a printed circuit board.

4. The contact spring assembly of claim 1, wherein said lower portion of said insertion chamber having upstanding support walls for defining lower edges to the corresponding recesses.

* * * * *